US006280257B1

(12) United States Patent
North et al.

(10) Patent No.: US 6,280,257 B1
(45) Date of Patent: Aug. 28, 2001

(54) CABLE DOCK FIXTURE WITH EMI SHIELDING

(75) Inventors: Dave North, Santa Clara, CA (US); Steve Dean, Chippewa Falls, WI (US)

(73) Assignee: Silicon Graphics, Inc., Mountain View, CA (US)

( * ) Notice: Subject to any disclaimer, the term of this patent is extended or adjusted under 35 U.S.C. 154(b) by 0 days.

(21) Appl. No.: 09/478,968

(22) Filed: Jan. 6, 2000

(51) Int. Cl.[7] ..... H01R 13/64; H01R 13/73

(52) U.S. Cl. ..... 439/680; 439/939

(58) Field of Search ..... 439/92, 607, 939, 439/374, 680

(56) References Cited

U.S. PATENT DOCUMENTS 4,386,814 * 6/1983 Asick ..... 439/607
5,626,190 * 5/1997 Moore ..... 166/65.1
5,838,550 * 11/1998 Morris et al. ..... 361/818

* cited by examiner

*Primary Examiner*—Brian Sircus
*Assistant Examiner*—Chaudrika Prasad
(74) *Attorney, Agent, or Firm*—Wagner, Murabito & Hao

(57) ABSTRACT

The present invention is drawn to a system for attaching and supporting a cable to an IO panel of an electronic component such as the IO back panel of a computer. The system is comprised of a cable dock coupled to an IO panel, with a gasket disposed within the cable dock to form a conducting path from the IO panel to the cable backshell. In particular, a cable dock is fixed to the IO panel where an IO connector is exposed. Once the cable backshell is plugged into the cable dock, the cable dock provides mechanical support for a cable assembly comprising the cable-end connector, the cable backshell and the cable. The cable assembly is secured by the cable dock rather than by the coupling made between the cable-end connector and the IO connector. The cable dock also orients the cable-end connector in coupling to the IO connector such that the cable backshell is prevented from being incorrectly plugged into the cable dock. Finally, the gasket disposed within the cable dock shortens the typical electrical conducting path between the IO back panel and the cable assembly. Unlike the prior art connector systems, current flows better between the IO panel and the cable assembly to form an EMI shield. Also, unlike the prior art EMI shielding, this EMI shield is well suited for shielding high frequency EMI.

22 Claims, 8 Drawing Sheets

CABLE DOCK FIXTURE WITH EMI SHIELDING

FIELD OF THE INVENTION

The present invention is related to supporting a cable attached to a computer system. Specifically, the present invention is related to a cable dock fixture for attaching and supporting a cable on a bulkhead.

BACKGROUND

A problem facing the computer industry is bulky and heavy cables. Specifically, as computer systems become more sophisticated, bulky and heavy cables are being adapted to transmit signals among these computer systems.

In the prior art, a cable typically has a cable-end connector coupled to a matching connector exposed on a side panel of a computer system. Coupling between these two connectors is relied upon to mechanically support the weight of the cables. Another mechanical support is provided by a screw locking mechanism implemented to screw and secure a cable backshell (containing the cable-end connector) to the side panel. Even now, in order to bear the weight of a cable attached to a computer system, the computer industry continues to rely on the coupling strength between two cable connectors and the strength of the screw locking mechanism.

However, the prior art approaches do not provide adequate mechanical support for rather bulky and heavy cables. The coupling strength between two cable connectors will not be strong enough to bear the weight of the cables. The mechanical support provided by the screw locking mechanism also will not be strong enough to bear the weight of the cables. As such, deleterious effects such as damage to the connectors and PCB's (printed circuit boards) can occur.

A related problem of attaching cables to a computer system is the difficulty of coupling a cable-end connector to its matching connector with the correct orientation. Often times, damage to the connector pins are caused by a cable-end connector being coupled to its matching connector with the incorrect orientation. This is especially problematic for high-density connector systems because the proper orientation of a high-density connector upon installation is difficult to determine.

Yet another related problem is the difficulty of assuring fully mated condition between large bulky cable-end connector and its matching connector exposed by a side panel of a computer system. Just prior to being coupled to its matching connector, the cable-end connector needs to be aligned with its matching connector. However, the alignment that could have been trivially done with conventional connectors is made cumbersome by the heavy weight of the large bulky cable at one end of cable-end connector.

The prior art connector system at the end of a cable also typically plays another role. Specifically, a prior art connector system is typically adapted to shield EMI (electromagnetic interference) radiation emitted by a computer system when transmitting signals to and from components outside of the computer. In particular, in order to shield EMI, the prior art connector system relies on the Faraday cage formed by a series of components. This series of components typically is comprised of a cable back shell, a gasket, a connector, another connector, another gasket and an input output panel.

However, this prior art approach is no longer adequate to shield EMI arising from high frequency signals transmission. At the moment, no prior art approach exists for addressing EMI generated by high frequency signals transmission. Rather, the prior art approach only exists for addressing EMI generated by transmission of low frequency signals. Nevertheless, computer industry is moving toward using high frequency signals because high frequency signals can carry more information at a time. Thus, EMI shielding for high frequency EMI is needed.

Thus, a need exists for being able to couple a bulky and heavy cable to a computer system without relying on coupling between connectors to support the weight of the heavy cable. A need also exists for being able to couple a bulky and heavy cable to a computer system without relying on a screw locking mechanism to support the weight of the cable. Another need exists for coupling a cable-end connector to its matching connector without ambiguous orientation. Yet another need exists for aligning a large cable-end connector and its matching connector without being difficult to assure fully mated condition between these two connectors. Finally, a need exists for a connector system that can shield high frequency EMI without relying solely on EMI shielding of the two-connector interface.

Fortunately, as will be explained in the following pages, the present invention successfully answers all of the needs stated above with a new approach to EMI shielding and cable support. Moreover, the present invention also provides additional benefits not available in the prior art approaches.

SUMMARY

The present invention is drawn to a system for attaching and supporting a cable on a bulkhead. In particular, the present invention implements a cable dock fixture that exposes a connector on a side panel of a computer system. As a cable backshell containing a cable-end connector is plugged into this cable dock fixture, the cable-end connector is coupled to the connector exposed by the cable dock fixture. This cable dock fixture supports the weight of the cable backshell and the cable. Also, the cable dock fixture has upper and lower structures, which match respectively to upper and lower structures of the cable backshell. The cable dock fixture itself constitutes a large, tapered entry into the exposed connector for providing a gradual assured alignment of the cable-end connector and the exposed connector. In addition, an EMI (electromagnetic interference) gasket is disposed within the cable dock to shield EMI that arises from transmitting high frequency signals.

With a cable dock fixture, the present invention avoids the difficulties of the prior art connector systems; furthermore, the present invention provides high frequency EMI shielding that is not possible with the prior art connector systems. In particular, the cable dock fixture of the present invention allows coupling a bulky and heavy cable to a computer system without relying on coupling between connectors to support the weight of the heavy cable. The cable dock fixture of the present invention also allows coupling a bulky and heavy cable to a computer system without relying on a screw locking mechanism to support the weight of the cable. Further, the cable dock fixture of the present invention allows coupling a cable-end connector to its matching connector without ambiguous orientation. In addition, the cable dock fixture of the present invention allows aligning a large cable-end connector and its matching connector without being difficult to assure fully mated condition between these two connectors. Finally, the cable dock fixture of the present invention constitutes a connector system that can shield high frequency EMI without relying solely on EMI shielding provided by the interface between the cable-end connector and its matching connector.

In one embodiment of the present invention, a cable backshell is attached by a system to a casing that houses electronic circuits. This system is comprised of an IO (input/output) panel of the casing, a cable dock, and a gasket disposed within the cable dock. In particular, the IO panel of the casing has an opening that exposes an IO connector coming from a PCB (printed circuit board) disposed within the casing. The cable dock is coupled to the IO panel around the opening such that the IO connector is exposed for coupling to a matching connector, which is meant to be a cable-end connector of the cable backshell. When the cable backshell is plugged into the cable dock, the IO connector couples to the cable-end connector such that the cable dock supports the weight of the cable and the cable backshell. Furthermore, a gasket is disposed within the cable dock for forming EMI shielding that provides a relatively short electrical path from cable backshell to IO panel, and can be tuned to shield specific frequency ranges.

Additionally, in the present embodiment, the cable dock has an upper guide surface and a lower guide surface that are shaped differently. The upper guide surface "ndovetails" with a matching upper surface of the cable backshell while the lower guide surface "dovetails" with a matching lower surface of the cable backshell. By matching the upper guide surface to its matching upper surface of the cable backshell, the cable backshell can only be plugged into the cable dock with the correct orientation.

Moreover, in the present embodiment, the cable dock constitutes a receptacle that aligns the cable-end connector with the IO connector. The "receptacle" constrains the cable backshell. Specifically, while the cable backshell is being plugged into the cable dock, the receptacle prevents the cable backshell (and in turn the cable-end connector) from moving parallel to the IO panel. As such, the cable dock (as a receptacle of the cable backshell) assures the alignment of the cable-end connector with the IO connector. In turn, features in the cable dock to accept corresponding cable backshell also assure that these two connectors are fully mated.

These and other objects and advantages of the present invention will no doubt become obvious to those of ordinary skill in the art after having read the following detailed description of the preferred embodiments which are illustrated in the various drawing figures.

BRIEF DESCRIPTION OF THE FIGURES

The accompanying drawings which are incorporated in and form a part of this specification, illustrate embodiments of the invention and together with the description, serve to explain the principles of the invention.

DETAILED DESCRIPTION OF THE FIGURES

Reference will now be made in detail to the preferred embodiments of the invention, a system for attaching and supporting a cable on a bulkhead, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to a person ordinarily skilled in the art that the present invention may be practiced without these specific details. In other instances, well known methods, procedures, components, and circuits have not been described in detail as not to unnecessarily obscure aspects of the current invention.

Figure 1:
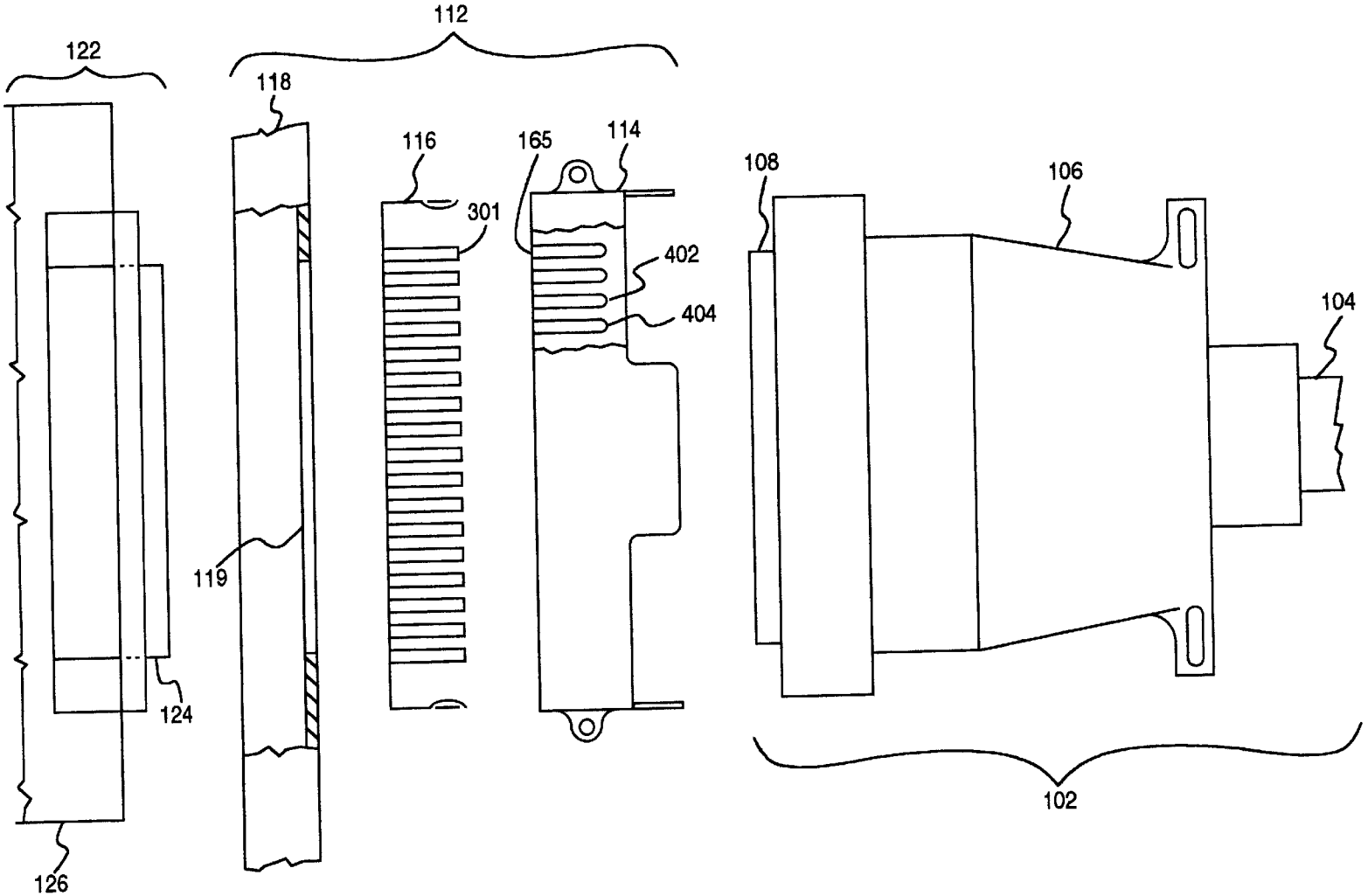
FIG. 1 illustrates the elements prior to being coupled together in one embodiment of the present invention.

Referring now to FIG. 1, elements of one embodiment of the present invention are illustrated prior to being coupled together. These elements are 1) a cable assembly 102 comprising a cable 104, a cable backshell 106 and a cable-end connector 108; 2) a cable docking assembly 112 comprising a cable dock 114, an EMI (electromagnetic interference) gasket 116 and an IO (input/output) panel 118; and 3) an IO connector 124 coming from a PCB 126 (printed circuit board 126).

Figure 2:
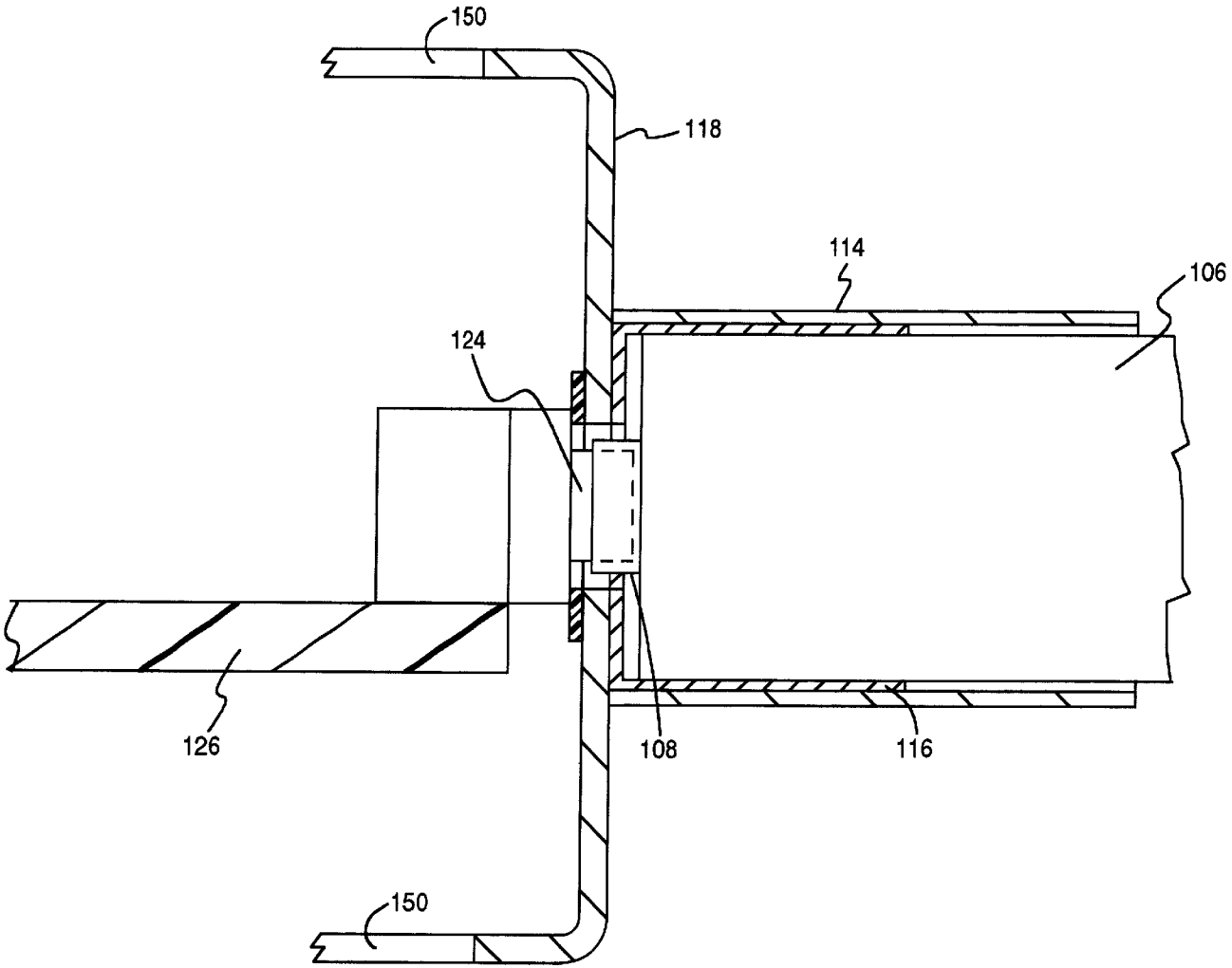
FIG. 2 illustrates the cross section of one embodiment of the present invention.

Referring now to FIG. 2, several elements from FIG. 1 are shown as being coupled together. In particular, cable docking assembly 112 is completely assembled: cable dock 114 is mounted to IO panel 118 while EMI gasket 116 is disposed within cable dock 114. The IO panel 118 is part of a casing 150 that houses electrical circuits. Also, IO connector 124 coupled to PCB 126 is attached to IO panel 118 such that inner connector 124 slightly protrudes from an opening 119 of IO panel 118. Furthermore, as a portion of cable assembly 102, cable backshell 106 has been inserted into cable dock 114 such that cable-end connector 108 is fully mated with IO connector 124 and such that cable backshell 106 is partially enclosed by cable dock 114.

Referring still to FIG. 2, the weight of cable assembly 102 is mostly borne by cable dock 114 rather than by the coupling strength between cable-end connector 108 and IO connector 124. Also, supporting the weight of cable assembly 102 by cable dock 114 advantageously offers stronger mechanical support to cable assembly 102 than that of a screw locking mechanism typically used in prior art connector systems. Furthermore, as shown in FIG. 2, cable dock 114 constitutes a receptacle that advantageously aligns cable-end connector 108 with IO connector 124 prior to their being fully mated. Thus; possible damages to pins of these connectors are much reduced.

Referring still to FIG. 2, EMI gasket 116 simultaneously makes contact with cable backshell 106, IO panel 118, and cable dock 114. Specifically, EMI gasket 116 is typically made of an electrically conducting material such as copper. Hence, while cable backshell 106 is plugged into cable dock 114, an electrical conducting path is formed between IO panel 118 and cable backshell 106 such that this path bypasses the interface of the two coupled connectors (IO connector 124 and cable-end connector 108). This electrical conducting path goes from IO panel 118 to a part of surface of cable backshell 106 enclosed by cable dock 114. In particular, this path is formed by IO panel 118, EMI gasket 116, cable dock 114 and cable backshell 106. As such, when signals are being transmitted between IO panel 118 and cable backshell 106, a Faraday cage is formed (around where IO connector 124 couples to cable-end connector 108) to confine EMI that arises from signal transmission through these two connectors.

In contrast, in the prior art connector system, a typical conducting path is formed with more components such as a cable back shell, a gasket within the cable back shell, a cable-end connector, an IO connector, an IO panel, and another gasket. Because each component making up a conducting path introduces electrical resistance to this conducting path, more components (within the conducting path) introduce more electrical resistance to degrade the conducting efficiency of the conducting path. Thus advantageously, current flows more easily through the electric conducting path of the present embodiment than through a typical conducting path relied upon in the prior art connector system. As a result, compared to the prior art connector systems, the present embodiment forms a more efficient Faraday cage for EMI shielding.

In the following figures of FIGS. 3, 4A–B, and 5A–B, elements of cable docking assembly 112 such as EMI gasket 116, cable dock 114 and IO panel 118 are described in more detail.

Figure 3:
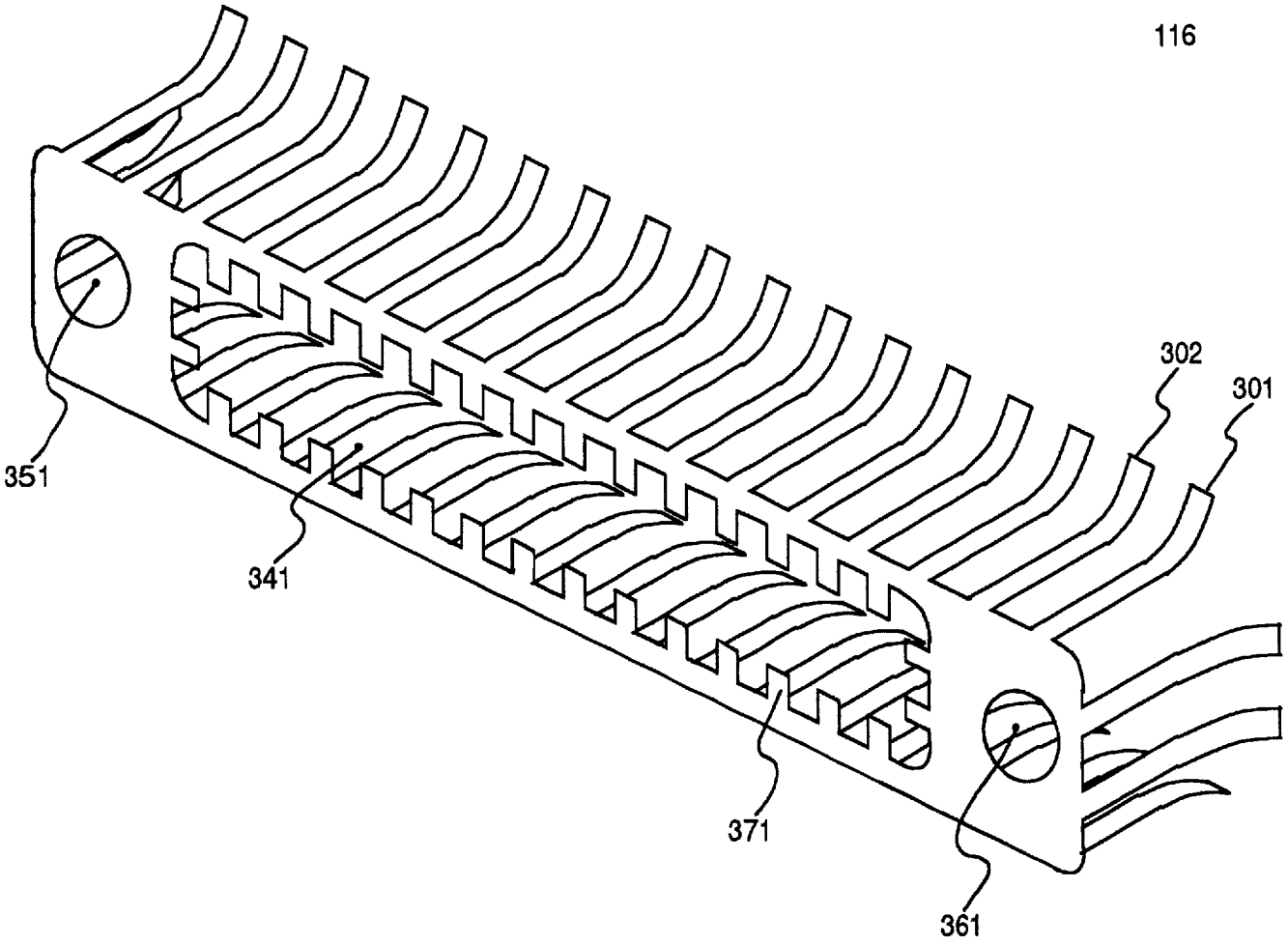
FIG. 3 illustrates a gasket according to one embodiment of the present invention.

EMI Gasket:

Referring now to FIG. 3, EMI gasket 116 is illustrated in isolation from other elements of the present embodiment. In the present embodiment, EMI gasket 116 is an element that is placed between IO panel 118 and cable dock 114 (both not shown in FIG. 3). On the one hand, an outer finger 301 and the rest of outer fingers will extend into cable dock 114. On the other hand, an inner tooth 371 and the rest of inner teeth will couple to IO panel 118.

Referring now to FIG. 3 in view of FIG. 2, each of outer fingers is spaced with a specific length away from its two neighboring outer fingers. This specific length is termed the characteristic length. For example, outer fingers 301 and 302 are separated with this characteristic length. In particular, when a electrically conducting path is formed (as described with respect to FIG. 2) between the IO panel 118 and cable backshell 106 for EMI shielding, the characteristic length of EMI gasket 116 allows EMI shielding for a specific range of EMI. Advantageously, with certain characteristic length, the present embodiment is well suited to provide EMI shielding for high frequency EMI that cannot be shielded by the prior art approach.

Continuing with FIG. 3, EMI gasket 116 has a main opening 341 and two round openings 351 and 361. Main opening 341 allows IO connector 124 to pass through when IO connector 124 is coupled to cable docking assembly 112. Round openings 351 and 361 allow mounting hardware to pass through when securing cable dock 114 onto IO panel 118. Examples of mounting hardware include screw, screw lock, and guide pins. In the present embodiment, EMI gasket 116 is made of copper. However, in other embodiments, other conducting materials are used for an-EMI gasket.

Figure 4A:
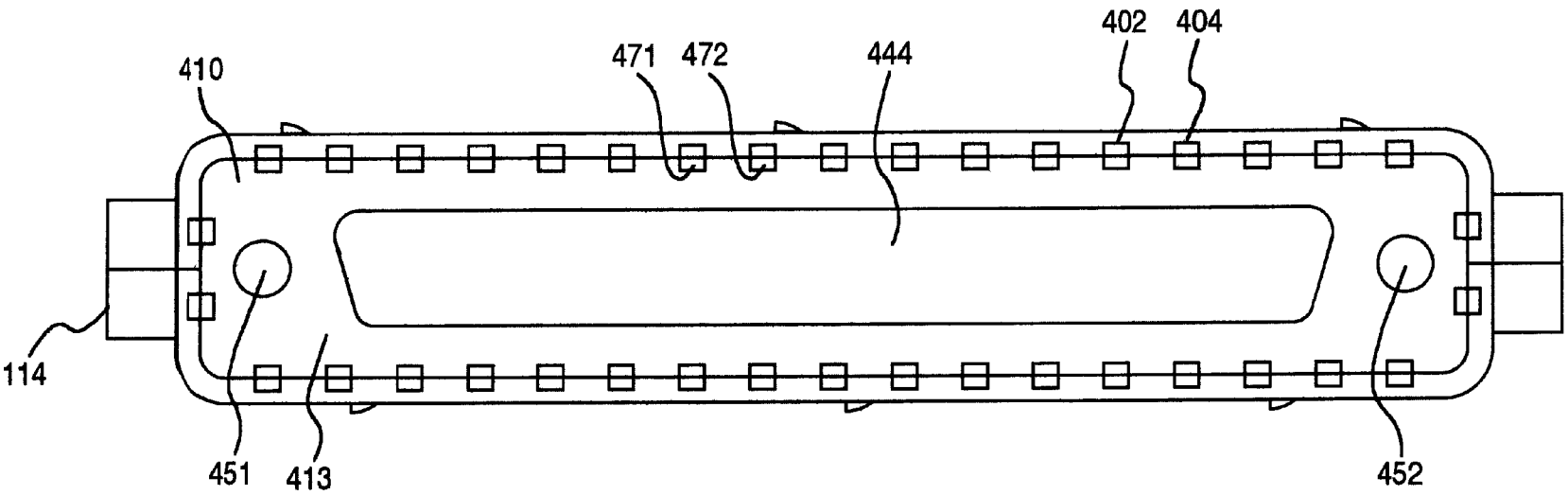
FIG. 4A illustrates the front view of a cable dock according to one embodiment of the present invention.

Cable Dock:

Referring now to FIG. 4A in view of FIG. 1, front view of cable dock 114 is illustrated. As shown, back side 410 of cable dock 114 has an opening 444 that will expose IO connector 124. Thus, when cable dock 114 is coupled to IO panel 118, IO connector 124 will show through cable dock 114. As such, when cable assembly 102 is inserted into cable dock 114, cable-end connector 108 can then unobtrusively couple to IO connector 124.

Continuing with FIG. 4A in view of FIG. 3, also can be seen on back side 410 are smaller openings that are gasket finger slots separated with fixed distance from each other. These gasket finger slots such as gasket finger slots 471 and 472 will enable EMI gasket 116 to couple to cable dock 114. Specifically, when coupling cable dock 114 to EMI gasket 116, gasket outer fingers described in connection with FIG. 3 will "poke through" and emerge from gasket finger slots such as gasket finger slots 471 and 472. Moreover, cable dock 114 shown here includes a plurality of striations (e.g., striations 402 and 404) spaced by the aforementioned characteristic length that is equal to the fixed distance between every two gasket fingers. These striations will collect gasket outer fingers to restrict displacement of EMI gasket 116. A plurality of striations is shown in FIG. 1 that collect the gasket fingers. For example, striations 402 and 404 are shown on cable dock 114 of FIG. 1. Additionally, a striation 165 is oriented to collect EMI gasket finger 301 (also shown in FIG. 3). The characteristic length can be chosen to shield a particular range of EMI, such as for example, high frequency EMI. The ability of the present embodiment to shield high frequency EMI is well suited to shield high frequency EMI emitted from where IO connector 124 couples to cable-end connector 108.

Referring still to FIG. 4A, in addition, two mounting openings 451–452 are also shown here; these mounting openings 451–452 allow mounting hardware (not shown here) to secure cable dock 114 itself to IO panel 118.

Figure 4B:
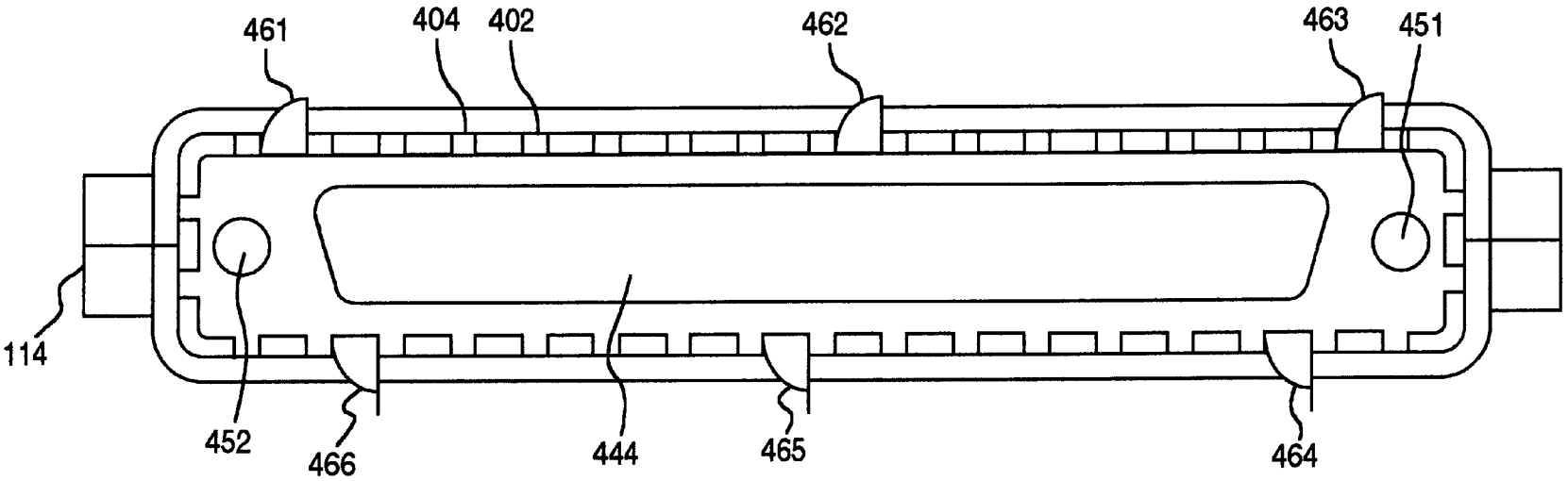
FIG. 4B illustrates the back view of the cable dock as illustrated in FIG. 4A.
Figure 5:
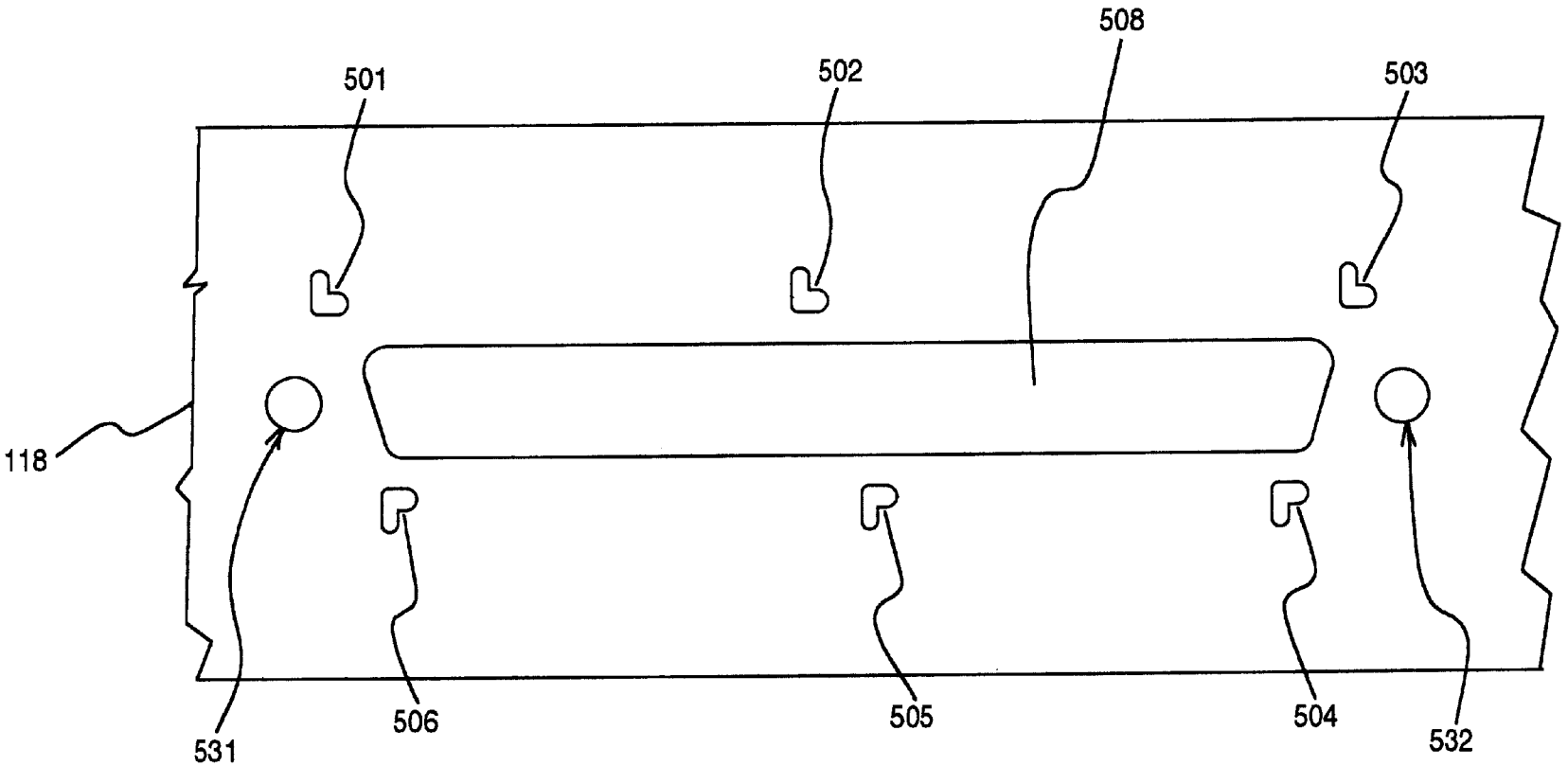
FIG. 5 illustrates the front side of an IO (input/output) panel according to one embodiment of the present invention.

Referring now to FIG. 4B, rear view of cable dock 114 is illustrated. As shown, a number of locking teeth 461-466 projecting out of back side 433. Locking teeth 461-466 will be inserted into locking teeth slots (to be shown in the next two Figures) on IO panel 118. In so doing, locking teeth 461–466 will provide another way to secure cable dock onto IO panel 118 in addition to (or instead of) using hardware. As such, cable dock 114 is more securely fixed to IO panel 118. From the rear view perspective, striation slots such as 404 and 402 can also be seen. Again, when coupling EMI gasket 116 to both IO panel 118 and cable dock 114, gasket outer fingers will pass through gasket finger slots and extend into interior of cable dock 114. IO Panel:

Referring now to FIG. 5 in view of FIG. 2, front view of IO panel 118 is illustrated for the present embodiment. Specifically, openings of different purposes are illustrated here.

First, opening 119 allows IO connector 124 to show through IO panel 118 when coupling IO connector 124 to IO panel 118. When inserting cable-end connector 108 fully into cable dock 114, cable-end connector 108 will progressively go through opening 444 of back side 433 of cable dock 114, main opening 341 of EMI gasket 116, and then partially into opening 119 of IO panel 118.

Second, locking slots 501–506 allow locking teeth 461–466 from cable dock 114 to lock onto IO panel 118, thereby securing cable dock 114 onto IO panel 118. This locking arrangement among locking teeth 461–466 and locking slots 501–506 allow cable dock 114 to accept and withstand even a cable assembly much heavier than a typical cable assembly.

Third, hole openings 531–532 allow hardware (not shown here) that go through cable dock 114 and EMI gasket 116 to go through IO panel 118 as well, thereby providing an additional way to secure cable dock 114 onto IO panel 118.

Figure 6A:
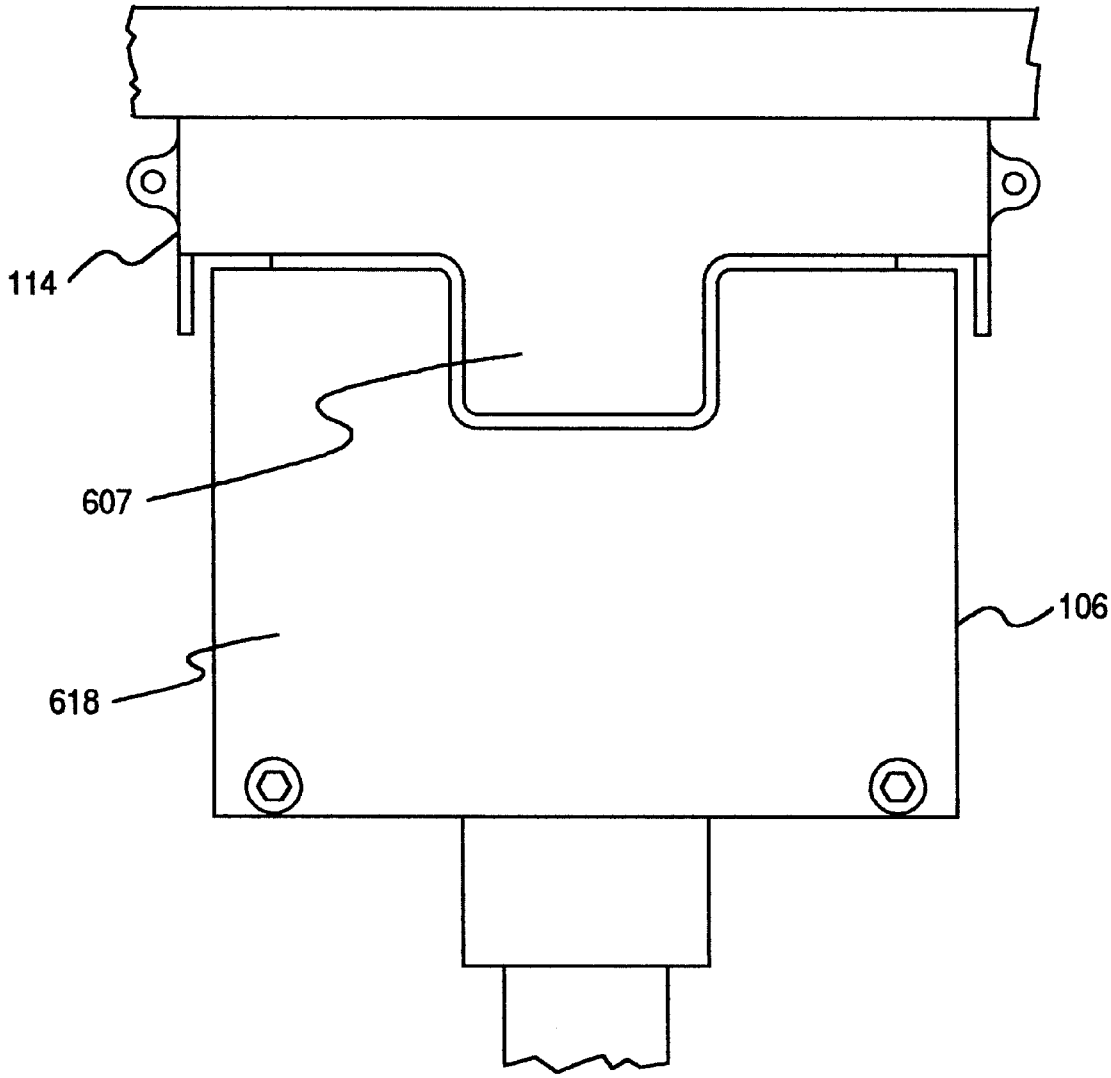
FIG. 6A illustrates the top view of the coupling between a cable dock and a back shell according to one embodiment of the present invention.
Figure 6B:
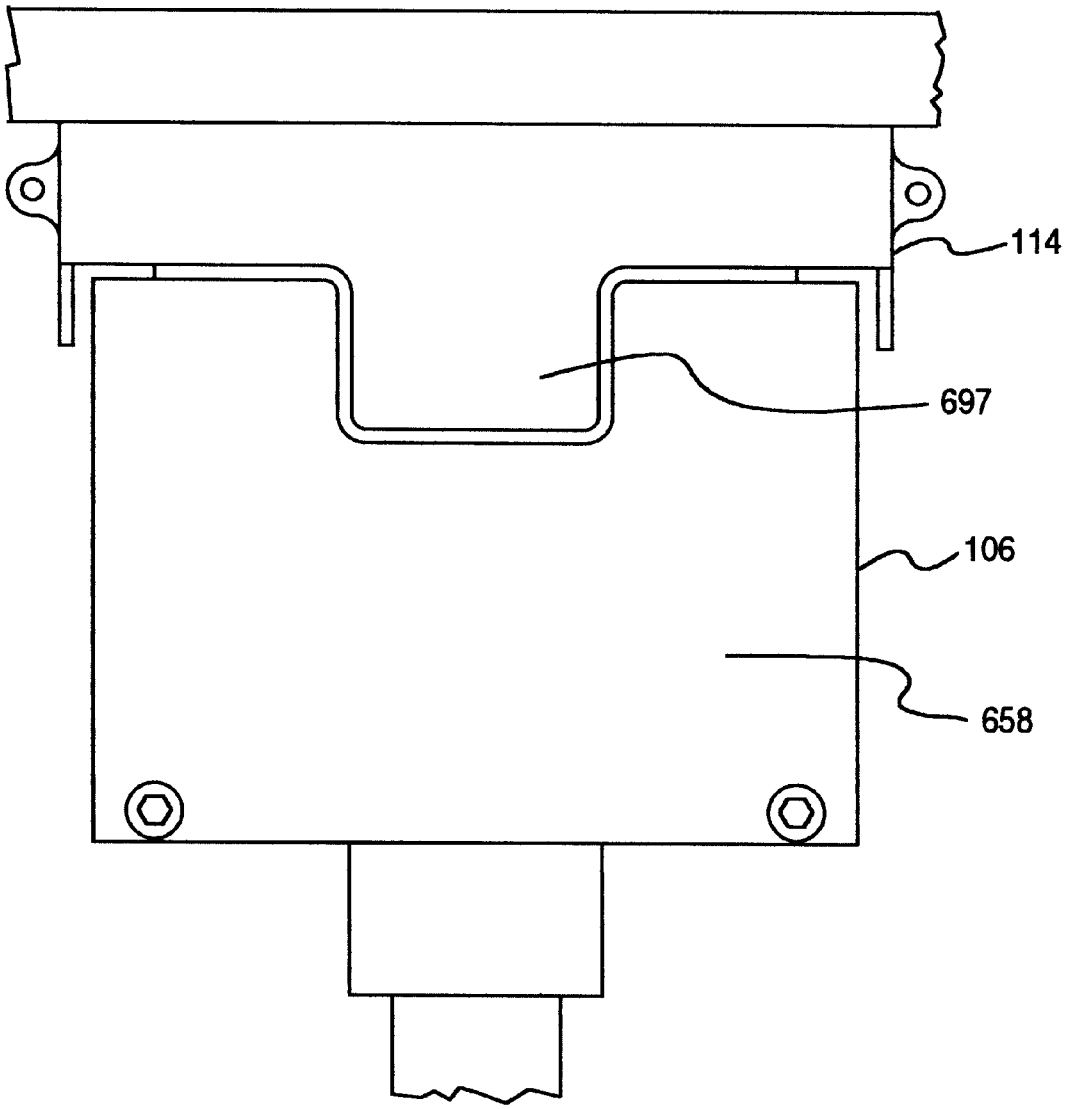
FIG. 6B illustrates the bottom view of the coupling between the cable dock and the back shell as illustrated in FIG. 6A.

Insertion Guides for Connectors:

Referring now to FIGS. 6A–B, top and bottom views of the coupling between cable assembly 102 and cable docking assembly 112 are respectively illustrated. The present embodiment uses differently shaped top and bottom insertion guides. Specifically, in the present embodiment, top insertion guide 607 of cable dock 114 (in FIG. 6A) is shorter than bottom insertion guide 697 of cable dock 114 (in FIG. 6B). On the other hand, top surface 618 of cable backshell 106 is shown to complement the shape of top insertion guide 607 of cable docking assembly 112. Similarly, bottom surface 658 of cable backshell 106 is shown to complements the shape of bottom insertion guide 697 of cable docking assembly 112.

In particular, referring still to both FIGS. 6A–B, when cable assembly 102 has been plugged into cable docking assembly 112, top insertion guide 607 uniquely mates to the edge of top surface 618. Similarly, bottom insertion guide 697 uniquely mates to the edge of bottom surface 658. As such, cable assembly 102 can be unambiguously inserted into cable dock 114 with the correct orientation.

Moreover, if cable backshell 106 is still being plugged into cable docking assembly 112 with incorrect orientation, bottom insertion guide 697 will not mate to top surface 618 of cable backshell 106. As such, cable backshell 106 is advantageously prevented from being completely plugged into cable docking assembly 112 with incorrect orientation. Consequently, connector pins are prevented from being damaged by incorrect connector coupling.

However, a top insertion guide and a bottom insertion guide of a cable dock need not be shaped as shown in FIGS. 6A–B. In some other embodiments, other pairs of distinctly shaped upper and lower alignment guides are used for these two alignment guides.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. The scope of the invention is intended be defined by the Claims appended hereto and their equivalents.

What is claimed is:

1. A system for attaching a cable backshell to a casing that houses electronic circuits, said system comprising:

an IO (Input/Output) panel of said casing, said IO panel having an opening that exposes an IO connector coupled to a PCB (printed circuit board)disposes within said casing;

a cable dock coupled to said IO panel around said opening such that said IO connector is exposed for coupling to a matching connector, wherein said IO connector is coupled to a cable-end connector of said cable backshell while said cable backshell is plugged into said cable dock;

an EMI (electric-magnetic interference) gasket disposed within said cable dock such that said EMI gasket makes contact with said IO panel and said cable dock, wherein while said cable backshell is plugged into said cable dock, said EMI gasket makes contact with said plugged-in cable backshell to form a conducting path that bypasses an interface between said IO connector and said cable-end connector, thereby forming an EMI shielding between said IO panel and said cable backshell, said conducting path including said IO panel, said EMI gasket, said cable dock, and said cable backshell.

2. The system of claim 1, wherein said IO panel has a plurality of locking slots for locking onto a plurality of teeth of said EMI gasket.

3. The system of claim 1, wherein said cable dock has a upper insertion guide and a bottom insertion guide that are shaped differently to guide the insertion of said cable backshell correctly into said cable dock, said top insertion guide to be uniquely mated to a matching top surface of said cable backshell, and said bottom guide to be uniquely mated to a matching bottom surface of said cable backshell such that said cable backshell is prevented from being plugged into said cable dock with incorrect orientation.

4. The system of claim 1, wherein said EMI gasket is comprised of:

a plurality of fingers spaced with a characteristic length specifically for shielding out a particular range of EMI; and a plurality of teeth adapted to hook and couple to said IO panel securely.

5. The system of claim 4, wherein said cable dock having a plurality of striations also spaced by said characteristic length, said plurality of striations collecting fingers of said EMI gasket for restricting displacement of said EMI gasket.

6. The system of claim 5, wherein said characteristic length is chosen to shield high frequency EMI emitted from a location where said IO connector couples to said cable-end connector.

7. The system of claim 1, wherein said cable backshell is comprised of:

a cable coupled to said back shell; and said cable-end connector coupled to said back shell, said cable-end connector adapted to couple to said IO connector while said cable backshell is plugged into said cable dock.

8. The system of claim 1, wherein said cable dock constitutes a receptacle adapted to align said cable-end connector with said IO connector while said cable backshell is being plugged into said cable dock, said cable dock preventing said cable backshell and in turn said cable-end connector from moving parallel to said IO panel, thereby assuring said cable-end connector and said IO connector are aligned.

9. A system for reducing EMI emitted from the coupling of an IO panel to a high frequency signal transmission cable, said system comprising:

a cable dock fixed to said IO panel around an opening that exposes an IO connector;

a cable backshell terminates said high frequency signal transmission cable, said cable backshell having a cable-end connector adapted to couple with said IO connector; and an EMI gasket disposed with said cable dock such that said EMI gasket makes contact with both said IO panel and said cable dock, wherein while said cable backshell is plugged into said cable dock said EMI gasket makes contact with said plugged-in cable backshell to form a conducting path that bypasses an interface between said IO connector and said cable-end connector, thereby shielding high frequency EMI emitted from said interface, said conducting path including said IO panel, said EMI gasket, said cable dock, and said cable backshell.

10. The system of claim 9, wherein said IO panel has a plurality of locking slots for locking onto a plurality of teeth of said EMI gasket.

11. The system of claim 9, wherein said cable dock has a upper insertion guide and a bottom insertion guide that are shaped differently to guide the insertion of said cable backshell correctly into said cable dock, said top insertion guide to be uniquely mated to a matching top surface of said cable backshell, and said bottom guide to be uniquely mated to a matching bottom surface of said cable backshell such that said cable backshell is prevented from being plugged into said cable dock with incorrect orientation.

12. The system of claim 9, wherein said EMI gasket is comprised of:

a plurality of fingers spaced with a characteristic length for shielding out high frequency EMI; and a plurality of teeth adapted to hook and couple to said IO panel securely.

13. The system of claim 12, wherein said cable dock having a plurality of striations also spaced by said characteristic length, said plurality of striations collecting said fingers of said EMI gasket to restrict displacement of said gasket.

14. A The system of claim 9, wherein said cable backshell is comprised of:

a cable coupled to said back shell; and said cable connector coupled to said back shell, said cable-end connector adapted to couple to said IO connector while said cable bulkhead is plugged into said cable dock.

15. The system of claim 9, wherein said cable dock constitutes a receptacle adapted to align said cable-end connector with said IO connector while said cable backshell is being plugged into said cable dock, said cable dock preventing said cable backshell and in turn said cable-end connector from moving parallel to said IO panel, thereby assuring said cable-end connector and said IO connector are aligned and fully mated.

16. An EMI gasket disposed within a cable dock coupled to an IO panel of a casing that houses electronic components, said EMI gasket facilitating the shielding of EMI emitted when signals are transmitted by, to, and from said casing by a cable whose cable backshell has a cable-end connector coupled to a matching IO connector exposed by said cable dock, said EMI gasket comprising:

a plurality of teeth adapted to hook to said IO panel such that said EMI gasket makes contact with said IO panel and said cable dock, wherein when said cable backshell is plugged into said cable dock, said EMI gasket makes further contact with said cable backshell to form an electrically conducting path that bypasses an interface between said IO connector and said cable-end connector, thereby forming an EMI shield between said IO panel and said cable backshell, said electrically conducting path including said IO panel, said EMI gasket, said cable dock, and said cable backshell; and a plurality of fingers spaced with a characteristic length for shielding out a particular range of EMI.

17. The system of claim 16, wherein said cable dock has a plurality of striations also spaced by said characteristic length, said plurality of striations collecting said fingers of said EMI gasket to restrict displacement of said gasket.

18. The system of claim 16, wherein said characteristic length is chosen to shield high frequency EMI emitted from where said IO connector couples to said cable-end connector.

19. A method for shielding EMI emitted from where a cable backshell couples to a casing that houses electrical circuits, said method comprising the steps of:

a) attaching a cable dock to a side panel of said housing at the location where an IO connector is exposed for coupling to a cable-end connector of said cable backshell, said cable dock adapted for docking said cable backshell when said cable-end connector is coupled to said IO connector;

b) disposing within said cable dock an EMI gasket which makes contact with said cable dock and said side panel, wherein when said cable backshell is plugged into said cable dock, said EMI gasket making further contact with said cable backshell such that an electrical conducting path is formed that bypasses an interface between said cable-end connector and said IO connector, thereby shielding EMI emitted from said interface, said electrical conducting path including said side panel, said EMI gasket, said cable dock, and said cable backshell.

20. The method of claim 19, wherein in said step b) said EMI gasket is implemented with a plurality of fingers spaced with a characteristic length for shielding out a particular range of EMI.

21. The system of claim 20, wherein said cable dock is implemented with a plurality of striations also spaced by said characteristic length, said plurality of striations collecting said fingers of said EMI gasket to restrict displacement of said gasket.

22. The system of claim 20, wherein said characteristic length is chosen to shield high frequency EMI emitted from where said IO connector couples to said cable-end connector.

* * * * *